United States Patent [19]

Chmela et al.

[11] 4,416,171

[45] Nov. 22, 1983

[54] TAB-TOP CAN OPENER

[75] Inventors: John F. Chmela, Mt. Prospect; Carl R. Fletcher, Arlington Heights; Norton Sarnoff, Northbrook, all of Ill.

[73] Assignee: Ensar Corporation, Wheeling, Ill.

[21] Appl. No.: 332,868

[22] Filed: Dec. 21, 1981

[51] Int. Cl.[3] ..... B67B 7/40; B67B 7/44

[52] U.S. Cl. ..... 81/3.46 R; 81/3.1 R; D8/40

[58] Field of Search ..... 81/3.46 A, 3.46 R, 3.1 R; 7/153, 151, 165, 169; D8/33, 34, 40, 18

[56] References Cited

U.S. PATENT DOCUMENTS

| | | | |
|---|---|---|---|
| 1,368,038 | 2/1921 | Larsen | 81/3.46 A |
| 4,253,352 | 3/1981 | O'Neal | 81/3.46 R |
| 4,309,921 | 1/1982 | Miller | 81/3.46 R |

OTHER PUBLICATIONS

Photographs of LIFTAB TM can opener for stay-on-tab cans, origin stamped on the opener identifying it to be LIFTAB Corp., Jackson, Mich. The opener bears the stamping "Patent Pending".

*Primary Examiner*—Roscoe V. Parker
*Attorney, Agent, or Firm*—Lee, Smith & Jager

[57] ABSTRACT

A tab-top can opener is provided which facilitates opening can tops of both the pull-off and stay-on type. The opener comprises a slotted body portion integrally formed with a handle at one end and a chisel-like starter edge at an opposite edge. A transverse tab slot extends through the body portion for tab insertion and holding while the tab-top is pried to open the can. A wall portion defining one side of the slot includes a striker projection extending slot-outwardly a distance from a lower side of the body to afford leverage in removing tab-tops.

7 Claims, 7 Drawing Figures

TAB-TOP CAN OPENER

BACKGROUND OF THE INVENTION

The invention relates to a can opener for prying open tab-tops of both the pull-off and stay-on variety.

Present day containerization of liquids, such as soft drinks and beer, have finger-manipulable tab-tops that eliminate the need for puncturing the can top with a conventional can opener. However, lifting the tab by hand is oftentimes difficult due to the close tolerance between the grasping portion of the tab and the can top.

When the tab is closely positioned on a can top the consumer must initially insert a fingernail underneath the tab to gain leverage for opening, or otherwise use some available thin-edged implement. Once the tab is pried away from the can top a sufficient distance for grasping with the consumer's fingers, tab opening may be completed. Not uncommonly,tabs break during opening. Also, broken fingernails may result, as well as injury to the consumer's finger from contact with sharp metal edges. Children find these tab tops even more difficult to manipulate in that they do not have the dexterity of the adult consumer. When children attempt to force tab tops open, cuts from these sharp metal edges might occur. This is particularly a problem with the ecology-type, or stay-on, tabs in which a sealing tongue is bent inwardly of the can as a result of prying the tab portion upwardly away from the can top.

One prior solution has provided a combination bottle cap opener and tab-top opener in an integral metal construction. From a conventional cap opener end there extends a flat body which widens then narrows to a point. Near the point, but generally at the widest portion of the body, a tab engaging struck-out slot is provided. Tab opening is achieved with a rotary motion closely resembling the motion used for conventional cap opening such that the user's hand pivots the opener about the tab opening end, and the long axis of the opener rotates from a position generally at right angles to the central axis of the container toward the container axis until opening is achieved. The prior art openers do not include chisel-like starter edges for initial tab prying when tabs are closely associated with can tops. Since sufficient rigidity is required, the combination-type opener is made of metal to permit bottle cap opening as well as tab opening. It would be desirable to utilize less costly materials for a tab-top opener.

Accordingly, it is the primary goal of the invention to provide an easy-to-use can opener for use with both stay-on and pull-off tab-tops that will positively open a can with reduced risk of injury to the user's hand.

It is an important goal of the invention to provide a tab-top can opener which includes a slotted-body for receiving a tab and securely holding it while rotation at a handle means prys the tab upwardly from the can top.

It is another goal of the invention to provide a tab-top can opener which includes a chisel-like starter edge for initial prying of the tab from the can top and then subsequent insertion into the slotted body for final opening.

It is an allied object of the invention to provide an easily manipulable can opener which by simple rotation of a handle will open both the removable and stay-on tab-tops.

It is a concomitant objective to provide a generally key-shaped tab-top opener which affords tab opening with a simple rotating maneuver around the long axis of the opener wherein the long axis of the opener remains substantially at right angles to the central axis of the can, and opening is achieved in a manner similar to turning a key in a door lock for ease of use by the consumer.

SUMMARY OF THE INVENTION

A tab-top can opener is provided and comprises a slotted body portion integrally formed with a handle at one end and a chisel-like starter at the opposite end. The body portion includes a tab slot transverse to a long axis of the opener extending through the body with openings at opposite upper and lower sides. The opening at the lower side forms the opening for tab insertion. The body has spaced-apart first and second wall portions connecting at opposite side walls to define the depth and width of the slot. At the lower side the first wall portion includes a striker projection extending slot-outwardly a distance from said lower side. The opener is useful for prying open cans with both removable and stay-on tab-tops by a simple rotating maneuver by the consumer and further facilitates initial prying of a tab from a can top surface followed by insertion of the tab into the tab insertion opening for final can opening.

BRIEF DESCRIPTON OF THE DRAWING

DESCRIPTION OF THE PREFERRED EMBODIMENT

Figure 1:
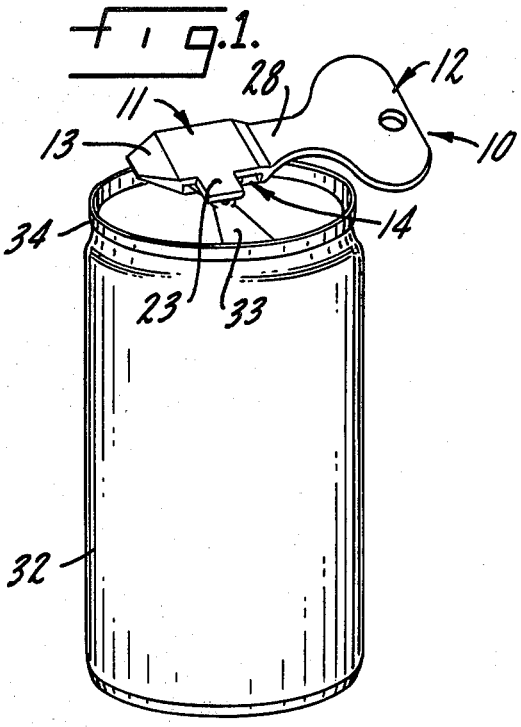
FIG. 1 is a perspective view of a conventional metal can having a ring-type removal tab-top engaged by the can opener of this invention in its preferred embodiment.

FIG. 1 depicts opener 10 engaged with a tab-top ready for tab removal and can opening. Opener 10 has slotted body portion 11 integrally formed with handle 12 at one end and chisel-like starter edge 13 at an opposite edge. Slotted body 11 includes a transverse tab slot 14 for tab engagement and securement during opening. A striker projection 23 permits the consumer to achieve leverage in prying the tab from the can. Can 32 is of a conventional construction and includes a removable-type ring tab-top 33 engaged with tab slot 14. Can 32 further includes a rim 34 which opener 10 clears during rotational movement of handle 12 by the provision of necked-down portion 28 forming a portion of handle 12.

Figure 2:
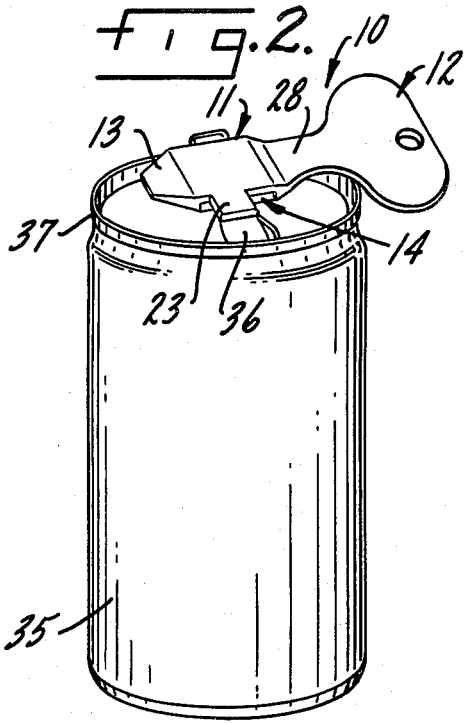
FIG. 2 is another perspective view of a conventional metal can having a stay-on, or ecology-type, tab-top engaged by the can opener of this invention in its preferred form.

FIG. 2 shows opener 10, in the identical embodiment as in FIG. 1, for use with can 35 having the stay-on tab-top 36. In this ecology-type tab-top, the striker projection 23 is useful for depressing the can-sealing portion of the tab-top 36 into the can while keeping the user's fingers well away from any sharp edges as the can is opened. Similarly, can 35 has a rim 37 which opener 10 accommodates at necked down portion 28 during prying of the tab-top.

FIGS. 3–7 are views of opener 10 as shown in FIGS. 1 and 2. In the elevational view of FIG. 3, opener 10 can be further described by noting that slotted body portion 11 includes an upper side 15 and lower side 16. The overall configuration for opener 10 is a key-like shape wherein handle 12 has upper and lower finger grasping surfaces 27 which extend above upper side 15 and below lower side 16 of slotted body 11 for ease of use by the consumer in attaining proper leverage for tab-top openings. Necked down portion 28 of handle 12 includes an inwardly curved edge portion 29 which meets lower side 16 and provides clearance space for can rims as shown in FIGS. 1 and 2. At the opposite side necked down portion 28 includes a straight edge portion 30 which is generally co-planar with upper side 15.

Figure 3:
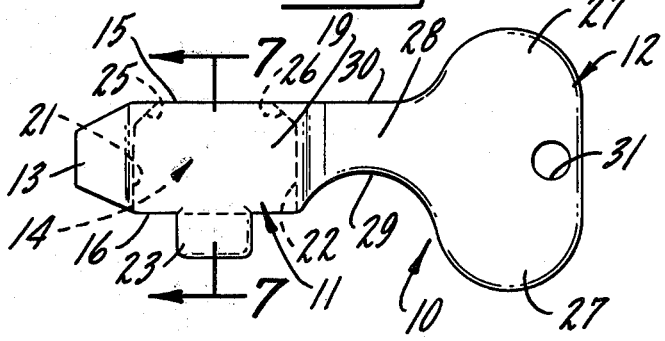
FIG. 3 is an elevational view of the can opener of the invention in the preferred embodiment as shown in FIGS. 1 and 2.
Figure 4:
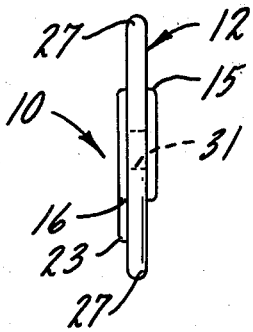
FIG. 4 is an end view of the can opener as shown in FIG. 3.

FIG. 4 is a side view looking generally from the right of FIG. 3 wherein handle 12 is shown extending above upper side 15 and below lower side 16. Striker projection 23 extends downwardly from lower side 16 for effective leverage in tab-top opening of removable-type tabs with the additional feature for ecology-type tabs of depressing the sealing portion of the tab inwardly of the can, as shown with respect to FIG. 2.

Figure 5:
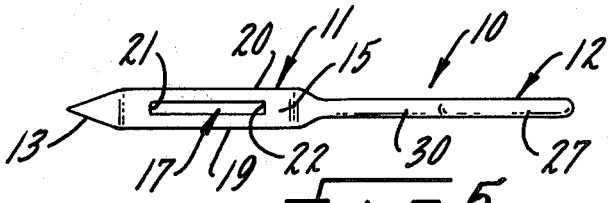
FIG. 5 is a top-view of the can opener as shown in FIG.3.

FIG. 5 shows a top view of opener 10 wherein upper side opening 17 of slot 14 opens at upper side 15 of slotted body portion 2.

Figure 6:
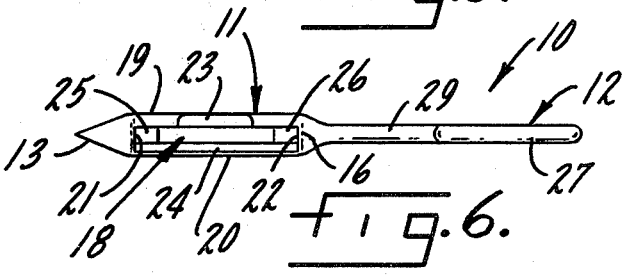
FIG. 6 is a bottom view of the can opener as shown in FIG. 3.

FIG. 6 shows a botton view of opener 10 wherein lower side opening 18 is a tab insertion opening at lower side 16, and is of a width sufficient to accept standard-size tabs.

When viewing FIGS. 5 and 6 together it will be appreciated that slotted body portion 11 includes a first wall 19 spaced-apart from a second wall 20 which are connected by opposite side walls 21 and 22 to define the depth and width of slot 14. First wall 19 includes striker projection 23 which extends slot-outwardly a distance from lower side 16. Chisel-like starter edge 23 is formed integrally with first wall 19 and second wall 20. Chisel-like starter edge 13 permits the consumer to initially slightly pry up a tab-top with subsequent insertion of tab through tab insertion opening 18.

The width of upper side opening 17 is preferably less than the opening at tab insertion opening 18. Side walls 21 and 22 include angled wall sections 25 and 26, respectively, generally adjacent upper side 17 to provide this reduced width. This width reduction allows the ring-type tab-tops to butt against angled walls 25 and 26 to prevent the ring from sliding outward of slot 14. Thus, a ring-top is securely held within slot 14 while opening by the user is achieved. However, the opening of the width of upper side opening 17 is sufficient to allow the stay-on type tab-top to project outward allowing striker projection 12 to properly contact and depress a sealing portion of the tab-top to force it can-inwardly during opening. Use with the stay-on type tab may be further appreciated when viewing FIG. 2 at tab-top 36. As shown in the Figures, for both ring-type and stay-on type tabs, slot 14 is provided in a size, defined by walls 19–22, sufficient to accommodate therein a major portion of the tabs, i.e., greater than one half.

At the end of slotted body 11 opposite starter edge 13, first wall 19 and second wall 20 meet necked down portion 28 of handle 12. The structure of opener 10 is accordingly integral and may be formed from a wide variety of materials. Preferably, nylon is highly suitable for this integral configuration. Other materials, for example plastic and metal, may be used. With the relatively high cost of metal, it is economically beneficial that less expensive materials are well suited to practice the invention.

Figure 7:
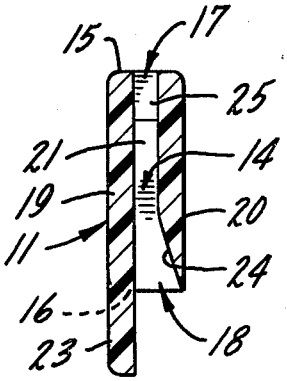
FIG. 7 is a cross-sectional view of the can opener as shown in FIG. 3 taken along line 7—7 looking in the direction of the arrows.

FIG. 7 is a cross-section of FIG. 3 further showing the unique characteristics of opener 10. It is seen that tab insertion opening 18, adjacent lower side 16, increases in depth slot-outwardly. This is achieved by second wall 20 terminating generally at lower side 16 in beveled edge 24. Once a tab-top is slightly pried upward from a can by means of starter edge 13, beveled edge 24 allows the user to easily slide opener 10 into tab-to engagement with the tab entering through tab insertion opening 18 and then positioning in tab slot 14. In some cases, starter edge 13 may not have to be initially used when a tab-top is not closely positioned to a can top. The beveled edge 24 may then be sufficient to urge the tab-top through tab insertion opening 18.

For easy storage or carrying on the person, hole 31 may be provided in handle 12 allowing it to be held on a key-chain or stored on a hook similar to the consumer using a normal house or car key. In use, opener 10 is manipulated much like a key. Rotation about the long axis, extending in a direction from hole 31 to starter edge 13, is achieved by the user grasping and turning handle 12 with the fingers of one hand, while grasping the can with the other hand well below the rim. The long axis is maintained generally at right angles to the central axis of the can with the consumer's hand at handle 12 to the side of the can. The invention permits safe opening by keeping the user's fingers away from sharp metal edges of tab-tops. The secure retention of the tab within slot 14 also minimizes accidental tab breaking.

Opener 10 can be easily used by children and avoids cut fingers or broken fingernails of both children and adults. While opener 10 has been described in a preferred embodiment, it will be understood that numerous shapes for the elements comprising opener 10 fall within the scope of the invention. Such equivalent structures are clearly intended to be encompassed by the invention as disclosed and claimed.

Accordingly, a tab-to can opener is provided which allows the consumer to insert a tab-top of a can into a slotted body portion and then by means of a striker projection and handle rotate the opener to pry open the tab-top quickly and easily without fingers and fingernails coming into contact with sharp metal edges which could lead to injury and fingernail damage. For situations where a tab-top is closely pressed to a tab-top, a starter edge is provided at one end of the slotted body for initially prying the tab-top upward with subsequent insertion through a widened tab insertion opening into the tab slot for secure positioning during can opening procedures. Both the removable type and stay-on ecology type tab-tops can be accommodated by the invention and opened with essentially the same manipulation by the consumer.

What is claimed is:

1. A tab-top can opener comprising a slotted body portion integrally formed with a handle at one end and chisel-like starter edge at an opposite end, said opener having a long axis extending in a direction from said handle end to said starter edge end, said body portion including a transverse tab slot extending therethrough with openings at upper and lower sides, the opening at the lower side being the opening for tab insertion, the body having spaced-apart first and second wall portions connecting at opposite side walls to define the depth and width of said slot, said tab slot being sized to accommodate a major portion of a can tab therein, at said lower side said first wall portion including a striker projection extending slot-outwardly a distance from said lower side, whereby said opener is capable of engaging a can tab within said slot transversely to said long axis, and said opener capable of opening a tab-top can by means of rotating the opener around said long axis, wherein during engagement of a tab in said tab slot the long axis is maintained in generally parallel relationship with the top of the can, wherein said opener is useful for prying open cans of both the removable and stay-on type tab-tops.

2. A tab-top can opener as in claim 1 wherein said second wall portion terminates at said lower side in a bevelled edge wherein the slot depth at said tab insertion opening increases slot-outwardly.

3. A tab-top can opener as in claim 1 wherein said handle has a greater overall height than said slotted body and includes finger grasping surfaces extending above and below the upper and lower sides of said body respectively.

4. A tab-top can opener as in claim 3 wherein said handle includes a necked down portion meeting said body and having a central section of lesser height than said body.

5. A tab-top can opener as in claim 4 wherein the central section of the necked-down portion includes an inwardly curved edge curving to meet the lower side of the body with a generally straight opposite edge co-planar with and meeting the upper side of the body, whereby said opener has a generaly key-like configuration and said curved edge affords can rim clearance during tab-top opening.

6. A tab-top can opener as in claim 1 wherein the slot width of the opening at the upper side of the body is less than at the tab insertion opening at the lower side.

7. A tab-top can opener as in claim 6 wherein the slot side walls angle slot-inwardly generally adjacent the upper side wherein the slot width adjacent said upper side decreases slot-outwardly.

* * * * *